US006775975B2

(12) United States Patent
Hebisch et al.

(10) Patent No.: US 6,775,975 B2
(45) Date of Patent: Aug. 17, 2004

(54) PUMP WITH A FLOW-REGULATING VALVE DEVICE AND AN INJECTOR DEVICE

(75) Inventors: Waldemar Hebisch, Gross Gerau (DE); Van Doan Nguyen, Neu Anspach (DE)

(73) Assignee: LuK Fahrzeug-Hydraulik GmbH & Co. KG, Bad Homburg (DE)

( * ) Notice: Subject to any disclaimer, the term of this patent is extended or adjusted under 35 U.S.C. 154(b) by 0 days.

(21) Appl. No.: 10/357,165

(22) Filed: Feb. 3, 2003

(65) Prior Publication Data

US 2003/0118458 A1 Jun. 26, 2003

Related U.S. Application Data

(63) Continuation of application No. PCT/DE01/02722, filed on Jul. 16, 2001.

(30) Foreign Application Priority Data

Aug. 1, 2000 (DE) ..... 100 37 872

(51) Int. Cl.[7] ..... F16D 32/02
(52) U.S. Cl. ..... 60/456; 417/310
(58) Field of Search ..... 60/456, 329; 417/300, 417/310, 440, 503; 418/15

(56) References Cited

U.S. PATENT DOCUMENTS 2,777,287 A * 1/1957 Tweedale ..... 60/396
2,983,266 A * 5/1961 Livermore ..... 123/434
3,620,646 A * 11/1971 Stevenson et al. ..... 417/79
3,641,879 A * 2/1972 Week et al. ..... 60/422
3,645,647 A * 2/1972 Ciampa et al. ..... 417/79
4,033,706 A 7/1977 Schaefer et al.
4,179,888 A * 12/1979 Goscenski, Jr. ..... 60/420
5,496,152 A 3/1996 Heise et al.
5,842,837 A * 12/1998 Nakayoshi et al. ..... 417/310
6,422,845 B1 * 7/2002 Wong et al. ..... 418/133

FOREIGN PATENT DOCUMENTS

DE 15 28 951 A1 9/1969
DE 298 23 903 A1 2/2000
EP 0 391 288 A1 10/1990
JP 56077591 A * 6/1981 ..... F04C/15/00

* cited by examiner

*Primary Examiner*—Edward K. Look
*Assistant Examiner*—Igor Kershteyn
(74) *Attorney, Agent, or Firm*—Darby & Darby

(57) ABSTRACT

A power-steering pump for a motor vehicle is used to pump fluid to an additional fluid-driven device such as a hydraulic motor of a ventilation fan. The pump has a flow-regulating valve and an injector device, where a jet of excess fluid streaming off the flow-regulating valve generates a suction effect that pulls return fluid from a suction pipe or a reservoir tank into the intake area of the pump. A fluid stream returning from the additional fluid-driven device enters the intake area through one or more fluid return channels that are separate from the injector channel.

6 Claims, 5 Drawing Sheets

PUMP WITH A FLOW-REGULATING VALVE DEVICE AND AN INJECTOR DEVICE

This is a continuation of international application Serial No. PCT/DE01/02722 filed Jul. 16, 2001.

BACKGROUND OF THE INVENTION

The invention relates to a pump, such as a power-steering pump, with a flow-regulating valve device and an injector device, where one or more fluid jets streaming off the flow-regulating valve generate suction to pull fluid back into the pump from a suction pipe connection or from a reservoir. The pump supplies the power-steering system in a motor vehicle and an additional fluid-driven device such as a hydraulic motor for a cooling fan. Pumps of this general kind belong to the known state of the art. For example, in a known version of a power-steering pump where the fluid flow is used for the additional purpose of powering a hydraulic fan motor in the ventilating system of a motor vehicle, the fluid returning from the hydraulic motor is introduced into the reservoir tank through a second injector device a short distance upstream of the point where the reservoir is connected to the flow regulation valve injector of the pump. Thus, the pump has two injectors that are arranged in immediate proximity of each other. It has been found that the fluid streams of this dual injector arrangement can influence each other at high rpm-rates, i.e., at high flow rates. The interaction between the fluid streams can interfere with the charger effect that takes place in the suction area, and it can cause cavitation which produces noise.

OBJECT OF THE INVENTION

The invention therefore has the objective to propose a configuration for a pump that supplies a power-steering device and a second consumer device such as a hydraulic fan motor, so that the aforementioned problems will not occur within a broad range of operating situations.

SUMMARY OF THE INVENTION

A pump according to the present invention, e.g., a power-steering pump, has a flow-regulating valve device and an injector device. A fluid stream directed from the flow-regulating valve to the injector device generates a suction effect in the injector device and thereby pulls fluid into the intake area of the pump from a suction pipe connection or from a reservoir. The pump supplies the power-steering system in a motor vehicle and an additional fluid-driven device such as a hydraulic motor for a cooling fan. In the pump according to the invention, at least one separate fluid-return orifice is arranged in addition to the injector outlet channel in the intake area of the rotating assembly inside the pump. At least a portion of the fluid returning from the additional fluid-driven device enters the intake area of the rotating assembly through the one or more separate fluid-return orifices.

One embodiment of the inventive pump has two separate return orifices leading into the intake compartment in addition to the injector outlet channel. Regardless of whether the pump has one or more than one stream of return fluid in addition to the injector stream, the preferred arrangement according to the invention requires that the one or more return streams and the injector stream enter the intake area of the rotating assembly independent of each other through separate orifices. According to the invention, the return streams must be prevented from influencing the injector stream.

As a further preference according to the invention, the arrangement of the orifices of the return channels in the intake area is symmetric in relation to the injector outlet channel. In particular, the return-channel orifices are arranged laterally to the right and left of the injector outlet channel as seen in the axial direction of the rotating assembly.

The improved apparatus, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWINGS

The invention will be explained below through examples that are illustrated in the drawings, wherein.

DETAILED DESCRIPTION OF PREFERRED EMBODIMENTS

Figure 1:
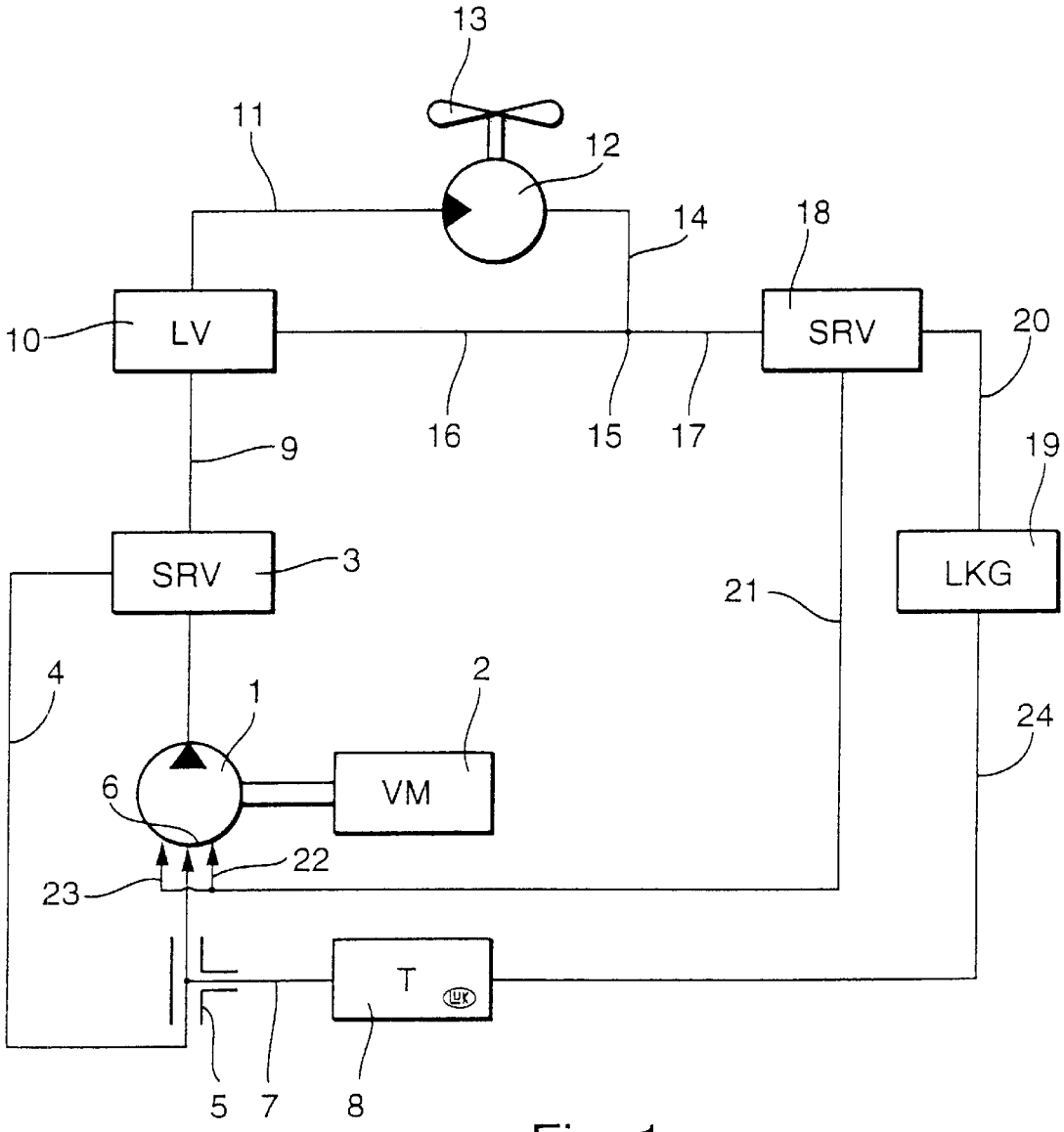
FIG. 1 represents a schematic diagram of a hydraulic circuit.

FIG. 1 represents a schematic diagram of the hydraulic circuit of a pump that supplies a fan-motor circuit and a power-steering device. A pump 1, driven, e.g., by a combustion engine 2 through a belt, generates a stream of fluid whose flow rate varies in magnitude depending on the rpm-rate of the combustion engine. The fluid flow is directed immediately within the pump to a flow-regulating valve 3. The flow-regulating valve 3 is adjusted so that when a certain flow rate is exceeded, for example 33 liter/minute, the valve 3 directs the rpm-dependent excess fluid flow through a short return channel 4 and an injector device 5 back to the intake compartment 6 of the pump. The injector device 5 has an entrance orifice for the fluid return conduit 7 from the reservoir tank 8. The tank 8 is arranged either directly at the pump or at a separate location and connected to the pump through a suction pipe and a hose or a pipe conduit.

The fluid flow for the supply of the hydraulic fan motor and the power-steering device is directed through a conduit 9 to a valve 10 that controls the fan. The fan control valve 10 is actuated through a fan control device (not shown in FIG. 1), so that the flow rate required for the fan is directed through a conduit 11 to the hydraulic motor 12 that drives the fan propeller 13. A return conduit 14 runs from the hydraulic motor 12 back to a conduit junction 15 where the return conduit 14 joins a bypass conduit 16 from the fan control valve 10. The fan control valve 10 is actuated, for example with an electromagnet, so that a larger or smaller flow rate is directed through the conduit 11, according to the variable requirements of the hydraulic motor 12. The excess amount of the fluid stream that is directed from the flow-regulating valve 3 to the fan control valve 10 but is not needed for the hydraulic motor 12 is sent through the conduit 16 which bypasses the fan motor 12.

The fluid streams running through the fan motor and through the bypass are united again at the junction 15 and directed through a common conduit 17 to a further flow-regulating valve 18 that limits the fluid flow to the power-steering device 19 to the required flow rate. The flow-regulating valve 18 allows only a limited amount of fluid, for example 10 liter/minute, to flow through the conduit 20 to the power-steering device 19. The balance of the fluid flow arriving from the junction 15 is sent through the conduit 21 to return orifices 22 and 23 in the intake area of the pump. The return orifices 22 and 23 enter the intake area of the pump separately from the injector 5. The return fluid from the power-steering device 19 is directed through the conduit 24 to the reservoir tank 8. By means of the injector device 5, the fluid is transported back to the intake area 6 of the pump through the conduit 7. It is an essential feature of the invention that the outlet of the injector 5 into the intake area 6 of the pump and the ports 22 and 23 for the excess fluid that was removed downstream of the fan motor are arranged as separate orifices into the intake area of the pump, so that the jets of fluid streaming from the injector 5 and from the return ports 22 and 23 cannot influence each other. As a preferred configuration, the ports 22 and 23 for the excess fluid returned from the valve 18 are arranged symmetrically in relation to the injector channel 5 which enters at the center of the intake area. It may also be practical to arrange the ports 22 and 23 directly at the suction compartments of the pump (also referred to as suction kidneys).

Figure 2:
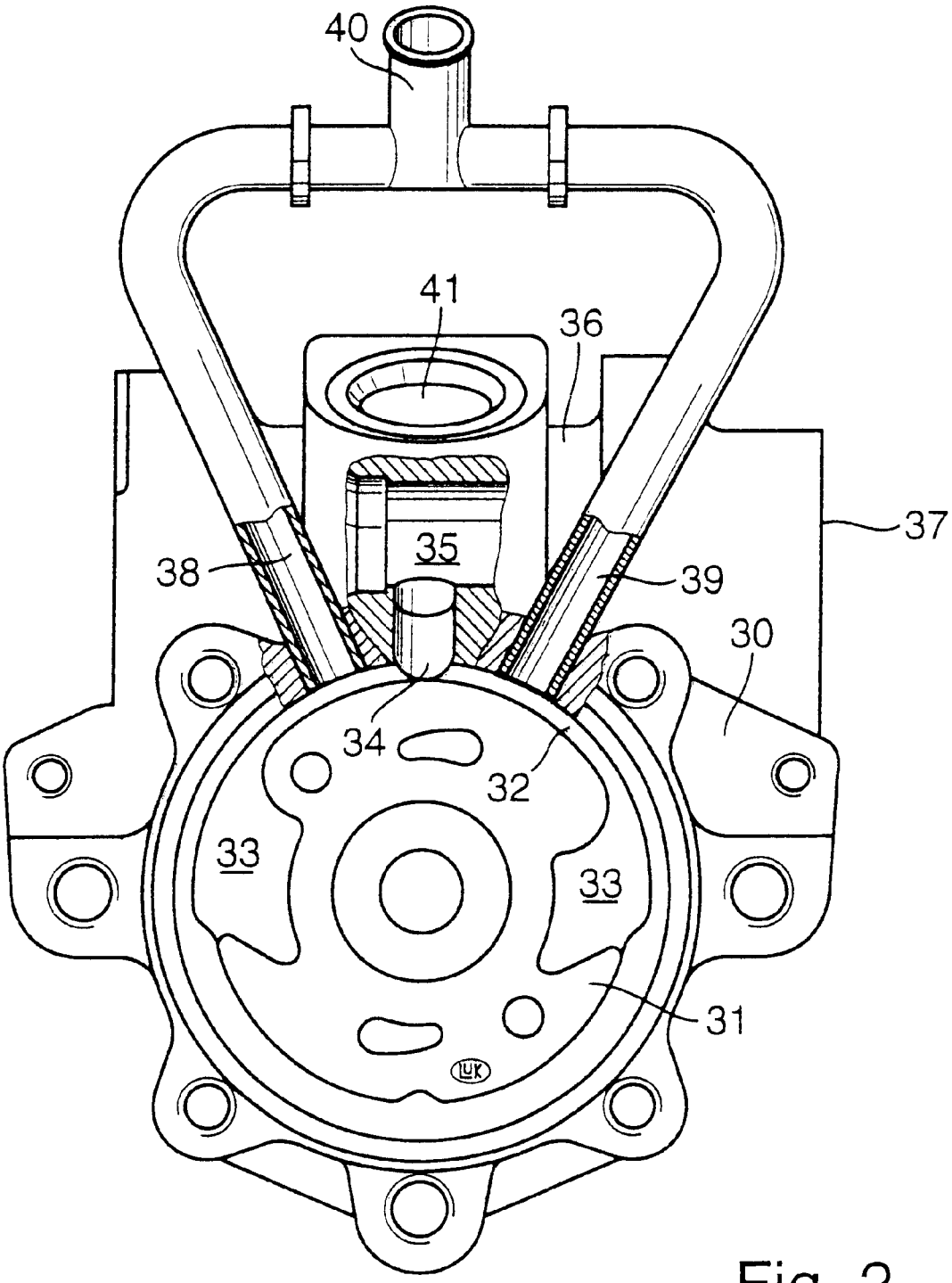
FIG. 2 illustrates the intake area of a pump.

FIG. 2 shows the intake area of a pump in an opened state. A pressure plate 31 is arranged in a pump housing 30. Other parts of the rotating assembly, such as a stroke ring, a rotor and vanes, are commonly known in the field of vane pumps and have been omitted in FIG. 2 in order to illustrate the intake area with the pressure plate more clearly. The intake area 32 extends at the top of the housing as an arc-shaped gap between the housing and the pressure plate to the two so-called intake kidneys 33 through which the incoming hydraulic oil streams into the rotating assembly. At the top center of the intake area 32, one will recognize the orifice of an injector channel 34 coming down at an angle from a valve bore 35 of a valve that is not shown in the drawing. The valve bore 35 contains the valve which is shown schematically as the flow-regulating valve 3 in FIG. 1. In the arrangement of FIG. 2, the valve is arranged in a housing part 36 that is integrated in the pump housing 30. The fluid stream to supply the hydraulic fan motor and the power-steering device leaves the pump through a pressure port 37 that connects to the conduit 9 (see FIG. 1). In the pump of FIG. 2, the fluid that is circulated internally in the pump through the flow-regulating valve 3 (see FIG. 1), the return channel 4 and the injector 5 reenters through the injector orifice 34. The additional return of the excess fluid that is not directed through the power-steering device is symmetrically distributed into two branches of a return conduit 40 and directed to the two orifices 38 and 39 in the intake area of the rotating assembly, so that the two streams of return fluid are arranged symmetrically in relation to the injector conduit 34 without causing interference between the respective fluid streams from the return conduit 40 and the injector channel 4. The oil that is returned from the power-steering system 19 (FIG. 1) to the reservoir tank 8 and is fed from there to the injector through the conduit 7 is pulled into the injector device through the suction port 41 shown in FIG. 2. This arrangement of the return conduit and the injector conduit provides a simple solution to modify a conventional power-steering pump with an internal flow-regulating valve in such a manner that both the hydraulically driven fan and the power-assisted steering system can be supplied without causing problems in the higher rpm-ranges of the pump.

Figure 3B:
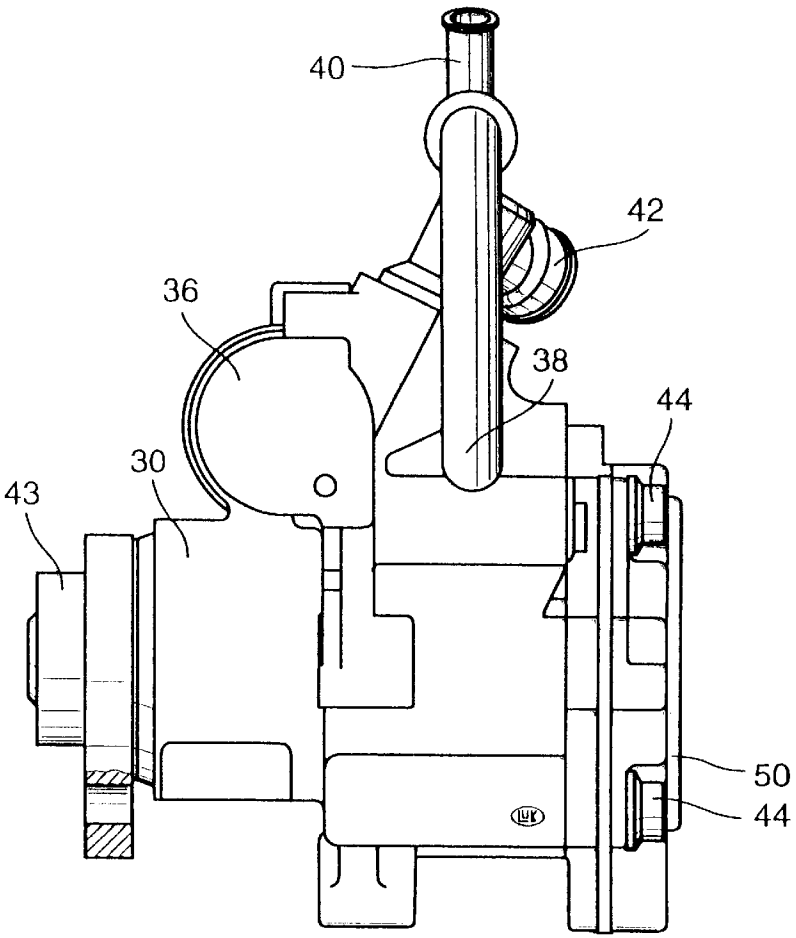
FIGS. 3*a* and 3*b* represent exterior views of a pump.
Figure 3A:
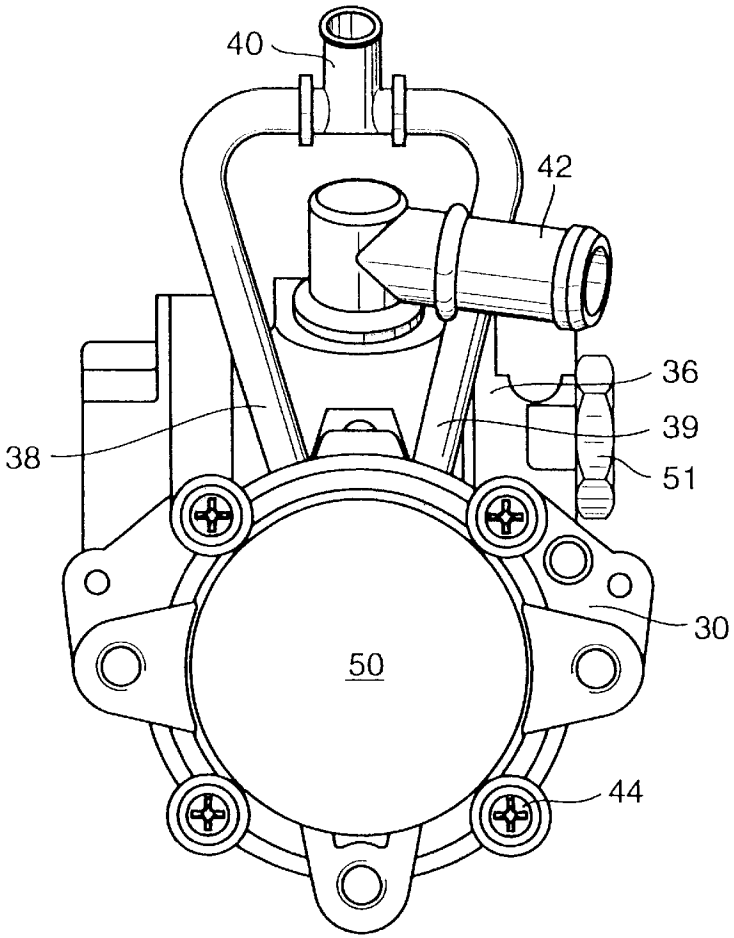

FIG. 3 shows a frontal view and a side view of the pump according to the invention with the housing closed. FIG. 3*a* shows the pump housing 30 closed by a cover 50. The return conduit 40, which carries the excess fluid that is not needed for the power-steering device, separates into the two branches 38 and 39 that enter at the top into the intake area of the pump. The valve housing 36 has a sealed pressure port 51 leading to the pressure conduit that supplies the ventilation-fan system and the power-steering system. A suction pipe 42 that is connected to the reservoir tank of the power-steering system leads into the injector where the jet of the internally circulated fluid from the flow-regulating valve creates a suction effect and thereby pulls along the fluid from the tank into the intake area of the rotating pump assembly. FIG. 3*b* shows a pump shaft 43 with a pulley flange through which the rotating assembly inside the pump, such as a vane pump rotor assembly, is driven. The housing 30 is sealed by the cover 50 by means of screws 44.

With the arrangement of the return conduits according to the invention, an additional injector for the fluid stream returning to the pump after the hydraulic fan motor is not necessary; the injector action of the flow-regulating valve is sufficient. The return flow from the hydraulic fan motor through the intake ports 38, 39 in FIG. 2, or 22, 23 in FIG. 1, is directed to the intake area 32 (or the intake area 6 in FIG. 1) without using an injector configuration of the ports and in combination with the fluid stream from the injector 5 provides a cavitation-free fluid intake of this multi-purpose pump. The pump according to the invention has the advantage that it allows a high flow rate in the internal return loop through the flow-regulating valve 3 with the injector 5 performing a charger function while also allowing a high flow rate in the return from the hydraulic motor 12 into the pump 1 without an additional injector. The injector 5 of the power-steering pump 1 remains unchanged, so that no design modifications are required in regard to the injector which, in turn, would necessitate a re-tuning of the injector 5. The inventive concept further allows a diversity of characteristics to be realized in the flow-regulating valve 3, because the return fluid stream from the hydraulic motor has no influence on the performance characteristics of the flow-regulating valve. It is not necessary to arrange an additional injector in the reservoir tank or in the suction pipe for the return of the fluid from the hydraulic motor. In contrast to an arrangement with two injectors, a pump configured in accordance with the present invention is capable of functioning even at high rpm-rates and with any fluid-flow characteristics, at low and high pressure levels. The return of the power-steering fluid through the suction port 41 remains unchanged. A remote arrangement of the reservoir tank as well as a direct attachment of the tank to the pump in the conventional manner remains possible. The advantage of arranging the return from a second fluid-consuming device in the manner proposed by the invention is, of course, applicable to other hydraulically powered accessory devices besides a hydraulic motor for a ventilation fan. Regardless of the specific hydraulic accessory device, the invention has the important advantage that a pump derived from a standard design of a power-steering pump, with substantially the same dimensions, the same port configuration and the same internal components, can be used for the hydraulically powered accessory device without causing the problem that the returning fluid streams negatively interfere with each other in the charging stage of the pump.

Figure 4B:
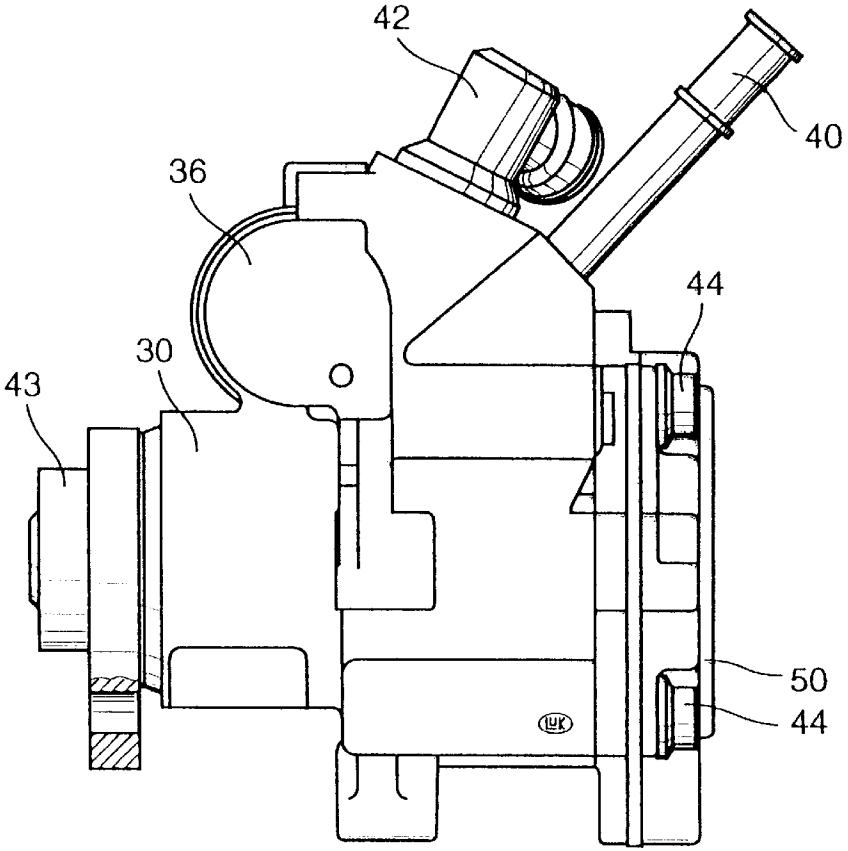
FIGS. 4*a* and 4*b* represent exterior views of a further pump.

The illustrations in FIG. 4 show a further embodiment of the pump according to the invention with a single, i.e., not bifurcated, return conduit 40 from the second consumer device, such as a hydraulically powered fan 12.

Figure 4A:
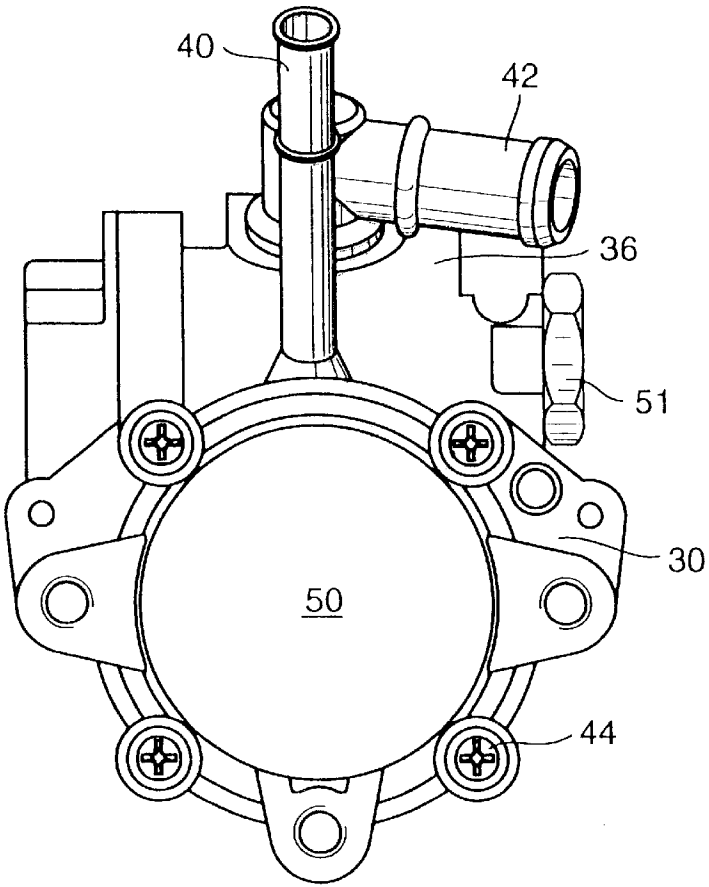
Figure 4C:
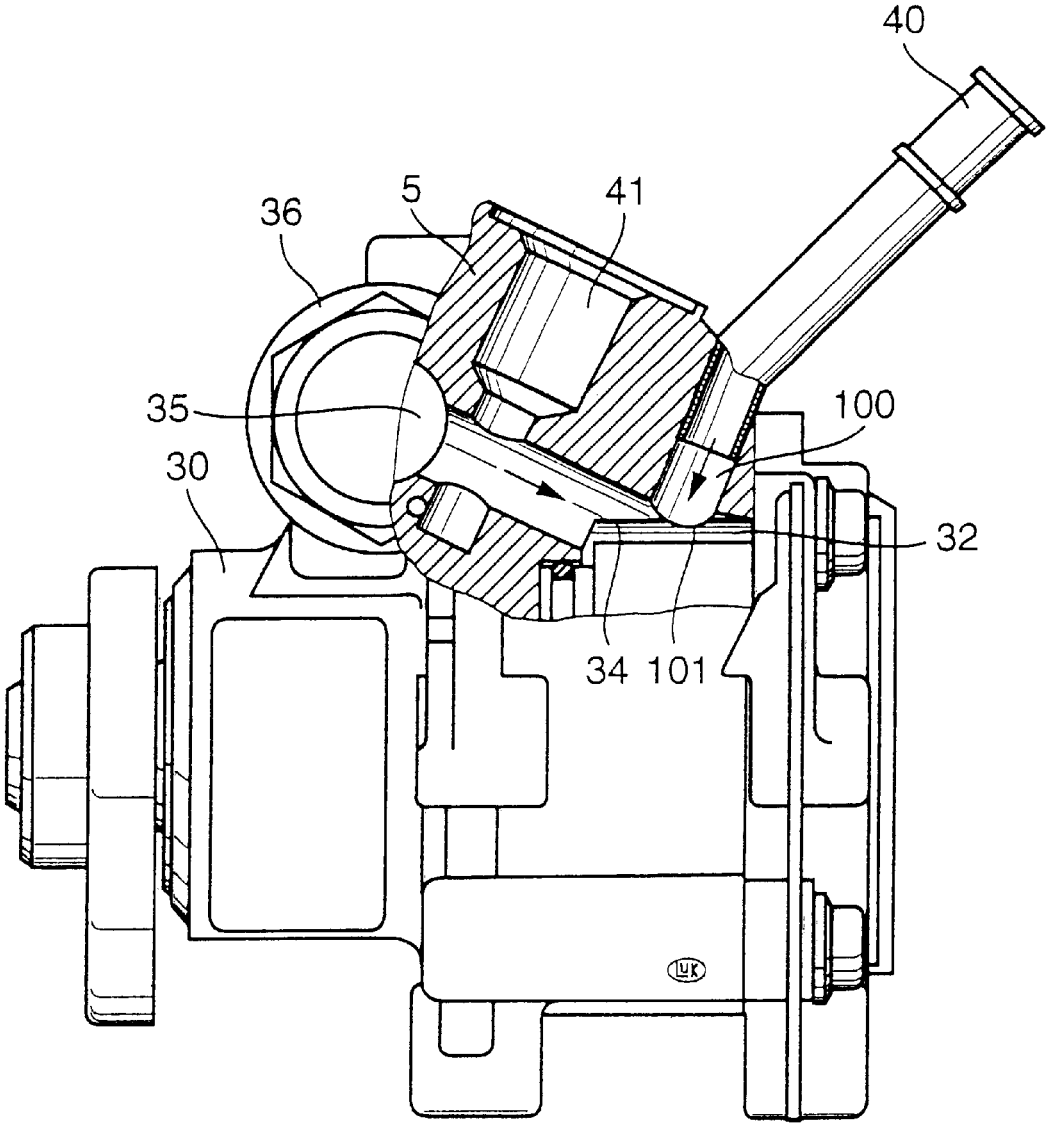
FIG. 4*c* represents another part of the further pump.

Except for the return conduit 40, the pump of FIG. 4*a* is substantially analogous to the pump of FIG. 3*a*. The same analogy exists between the FIGS. 4*b* and 3*b*. Corresponding parts are identified by the same reference symbols, and their description will therefore not be repeated here. FIG. 4*c* illustrates the important concept of the invention, namely that the orifice 34 of the injector channel 5 into the intake area 32 of the pump and the orifice 101 of the return channel 100 at the end of the return conduit 40 from the second consumer device are arranged so that the two orifice openings enter the intake area 32 of the pump independently of each other at separate locations. This arrangement avoids the problem that the fluid jet that forms in the injector 5 is disturbed by the stream of return fluid from the channel 100. The foregoing example demonstrates how the invention can be applied in a pump with a single return conduit 40 for the second hydraulically operated device.

What is claimed is:

1. A pump for pumping a fluid to a power-steering device and to an additional fluid-driven device in a motor vehicle, said pump comprising a rotating assembly, an intake area of the rotating assembly, a flow-regulating valve device, an injector device, an injector channel through which a first stream of said fluid enters the intake area, and at least one fluid return channel through which a second stream of said fluid enters the intake area, wherein the at least one fluid return channel is separate from the injector channel and wherein the second stream comprises at least a portion of the fluid streaming off the additional fluid-driven device, wherein the at least one fluid return channel comprises two fluid return channels.

2. The pump of claim 1, wherein the additional fluid-driven device comprises a hydraulic motor driving a ventilation fan.

3. The pump of claim 1, wherein the at least one fluid return channel and the injector channel have separate orifices into the intake area.

4. The pump of claim 1, wherein the second stream of fluid has no influence on the first stream of fluid.

5. The pump of claim 1, wherein the two fluid return channels have, respectively, a first orifice and a second orifice into the intake area, the injector channel has an injector orifice into the intake area, and wherein the first and second orifices are arranged symmetrically in relation to the injector orifice.

6. The pump of claim 5, wherein the first and second orifices are arranged, respectively, to the right and left of the injector orifice as seen in an axial direction of the rotating assembly.

* * * * *